US006510951B1

(12) United States Patent
Bertoni et al.

(10) Patent No.: US 6,510,951 B1
(45) Date of Patent: Jan. 28, 2003

(54) HOLDER FOR SELF-INKING STAMPS

(76) Inventors: Roberto Bertoni, 22 int., Via Fondi, 55041 Camaiore (IT); Vincenzo Luisi, 77, Via Fabio Filzi, 55049 Viareggio (IT)

( * ) Notice: Subject to any disclaimer, the term of this patent is extended or adjusted under 35 U.S.C. 154(b) by 0 days.

(21) Appl. No.: 09/786,318

(22) PCT Filed: Apr. 18, 2000

(86) PCT No.: PCT/IT00/00156

§ 371 (c)(1),
(2), (4) Date: Mar. 2, 2001

(87) PCT Pub. No.: WO01/02185

PCT Pub. Date: Jan. 11, 2001

(30) Foreign Application Priority Data

Jul. 2, 1999 (IT) ..... FI99A0152

(51) Int. Cl.[7] ..... A47F 13/00
(52) U.S. Cl. ..... 211/39
(58) Field of Search ..... 211/39, 163, 13.1, 211/85.1, 85.5

(56) References Cited

U.S. PATENT DOCUMENTS 652,257 A * 6/1900 Folger ..... 211/39
954,793 A * 4/1910 Graham ..... 211/39
1,562,369 A * 11/1925 Schmidt ..... 211/39
4,534,471 A * 8/1985 Zahn et al. ..... 211/39
5,772,050 A * 6/1998 Shih ..... 211/39

FOREIGN PATENT DOCUMENTS

DE 351 294 4/1922
DE 29 36 065 A1 3/1981

* cited by examiner

*Primary Examiner*—Alvin Chin-Shue
*Assistant Examiner*—Sarah Purol
(74) *Attorney, Agent, or Firm*—Browdy and Neimark, P.L.L.C.

(57) ABSTRACT

A self-inking stamp holder, said stamps comprising a box-like frame or case with openings on at least two opposite sides and a slide containing an overturnable stamping member and an inking pad, elastically sliding within said frame or case between the openings. The holder is formed by an upright and a plurality of main wings extending obliquely in a parallel relationship from at least one face thereof each wing being capable of holding a stamp. Retaining means are associated to each of the main wings for abutting on said frame or case, when held from a respective main wing, from the opposite side of the main wing. To firmly secure the stamp in position thereon.

15 Claims, 4 Drawing Sheets

HOLDER FOR SELF-INKING STAMPS

REFERENCE TO RELATED APPLICATIONS

The present application is the national stage under 35 U.S.C. 371 of international application PCT/IT00/00156, filed Jul. 2, 1999, which designated the United States, and which international application was published under PCT Article 21(2) in the English language.

FIELD OF THE INVENTION

The present invention relates to a self-inking stamp holder.

BACKGROUND ART

As is known, self-inking stamps are formed by a box shaped frame or case with two diametrically opposed openings and a slider engaging with one of said openings and elastically movable to and from the opposite opening.

The slider contains an inking pad and an overturnable stamping element and is connected to the frame through a kinematic motion which, as a result of the movement of the slider, causes the stamping element to overturn from a rest position, in which the stamping element is in contact with the inking pad, and a stamping position, rotated 180° with respect to the rest position, in which as a result of the slider movement the stamping element comes forward from the frame opening. The movement of the slider occurs as a consequence of a pressure exerted thereon against elastic means keeping the slider in the rest position.

Self-inking stamps have a widespread use in view of the fact that, contrary to conventional hand stamps, they do not need for a separate tank containing the inking pad. This makes the stamping operation easier and allows the stamp to be transported in a bag or even in a pocket, without any risk of soiling the nearby objects or the garment, and without the need of having the inking pad tank available for the use of the stamps.

However, while as regards the conventional hand stamps there have been made available a lot of collecting devices to which the stamps are hung to be kept in a tidy way and to be easily retrieved, a similar device does not exist for the self-inking stamps, which, therefore, are usually kept on the working tables and desks without any prefixed order, thus making very difficult to find the stamp which is being looked for.

The object of the present invention is to provide a device for holding self-inking stamps, by means of which they can be kept in an orderly way and little room, thus overcoming the above mentioned drawbacks.

In particular, it is an object of the present invention to provide a self-inking stamp holder of the above mentioned type, which can support a relatively large number of stamps, while being of a minimum size, and allow for each stamp to be quickly identified.

SUMMARY OF THE INVENTION

These objects are reached with the self-inking stamp holder according to the present invention comprising an upright and a plurality of parallel main wings extending obliquely from at least a face thereof, each main wing being fit for holding a stamp. Retaining means are associated to each main wing, said means abutting on the outer side of the case or frame of the stamp from the opposite side of the corresponding main wing to firmly secure the stamp in position thereon. In a preferred embodiment of the invention the upright extends from a support base to which it is pivotally connected and by means of which the holder can be set on a flat horizontal surface. In another embodiment of the invention, the upright comprises hook means for hanging the holder to a vertical surface.

Preferably, the retaining means are formed by auxiliary wings extending from the upright, each auxiliary wings being arranged above a corresponding main wing, in either a parallel or divergent relationship with respect to the main wing.

Further characteristics and/or advantages of the self-inking stamp holder according to the present invention will appear clearly from the following description of embodiments thereof, given as non-limiting examples with reference to the attached drawings.

BRIEF DESCRIPTION OF THE DRAWINGS

In the drawings:

With reference to FIGS. 1, 2, 3 and 4, the holder for self-inking stamps according to the present invention comprises a upright 1 of a substantially parallelepiped, hollow shape, pivotally connected to a base 2 that allows the holder to be set on a plane. Main wings 3 extends inclined upwardly from each of the opposite faces of upright 1 of larger width, in a parallel and spaced relationship.

Respective auxiliary wings 4 extend immediately above main wing 3 and parallel thereto.

Each of main wings 3 constitutes an hanging means to which a self-inking stamp is hung through its box-like frame or case, while auxiliary wing 4 abuts on the outer side of the box-like frame or case to counterbalance the weight of the stamp on main wing 3 which would result in downward rotation of the stamp and thus in falling thereof.

Figure 4:
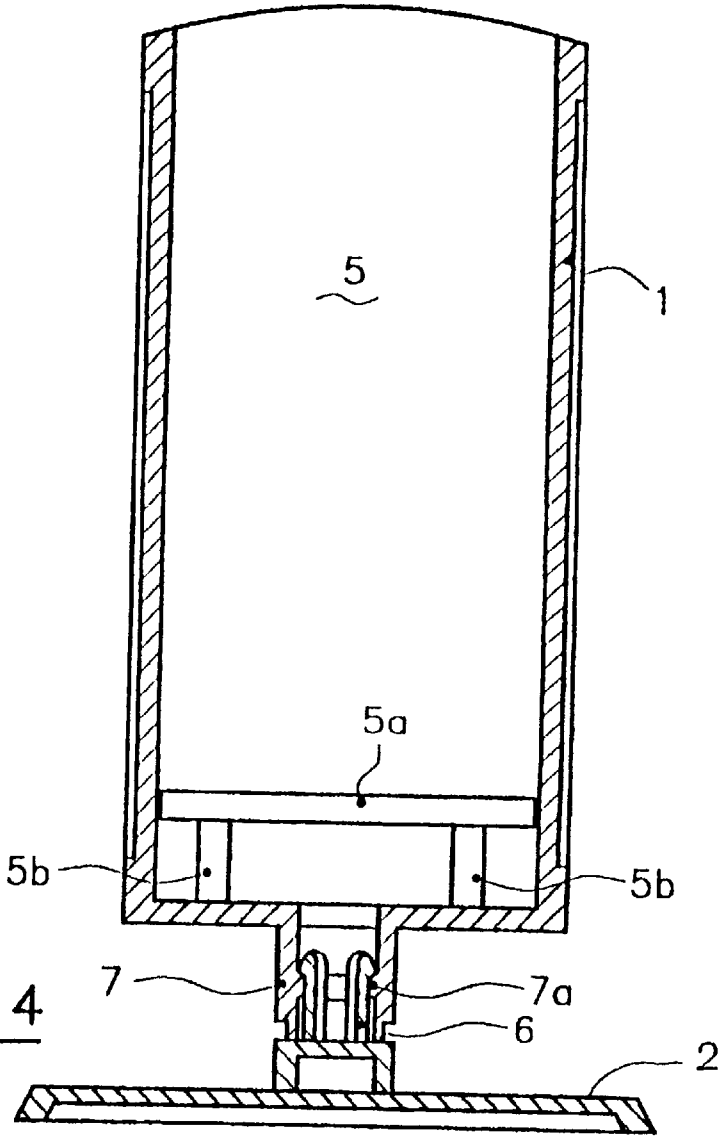
FIG. 4 is a sectional side view of the holder taken along line III—III of FIG. 3.
Figure 3:
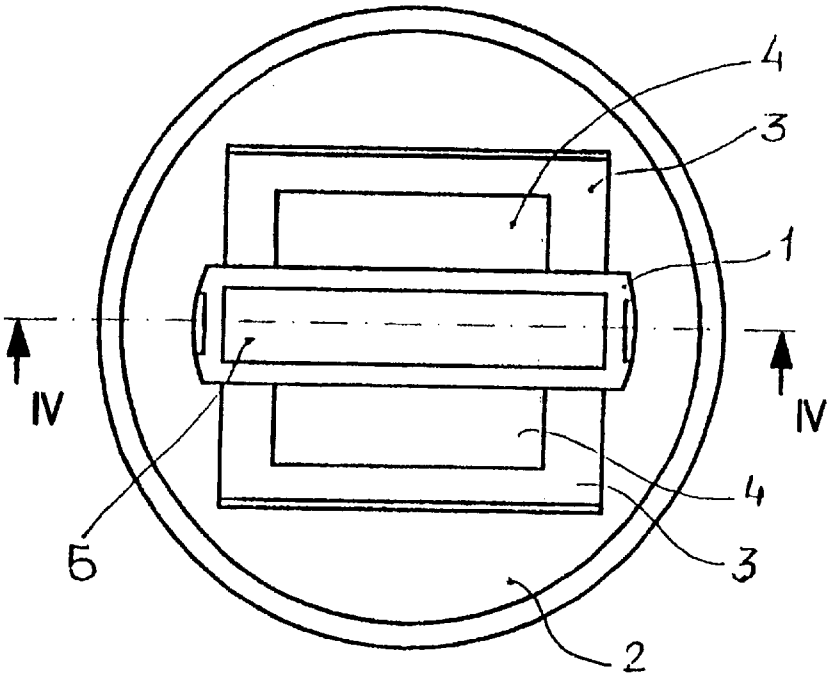
FIG. 3 is a top plan view of the holder according to the previous figures.

As shown in FIGS. 3 and 4, advantageously upright 1 is a hollow body with one or more chambers, generally indicated at 5, for housing pens, pencils, and the like. If the depth of a chamber 5 is greater than the average length of a pencil, a movable base 5*a* supported by spacers 5*b* may be provided at the bottom of chambers 5.

The pivotal connection between upright 1 and base 2 is obtained by means of a pair of axially coupled sleeves 6 and 7 extending from base 2 and the bottom side of upright 1 respectively. Sleeve 6 is formed by three elastically diverging arms that, once engaged within sleeve 7, radially urge against inner wall of sleeve 7 and abut through rounded end thereof against an annular projection thus preventing any unwanted disengagement.

In a variation of the present invention shown in

Figure 5:
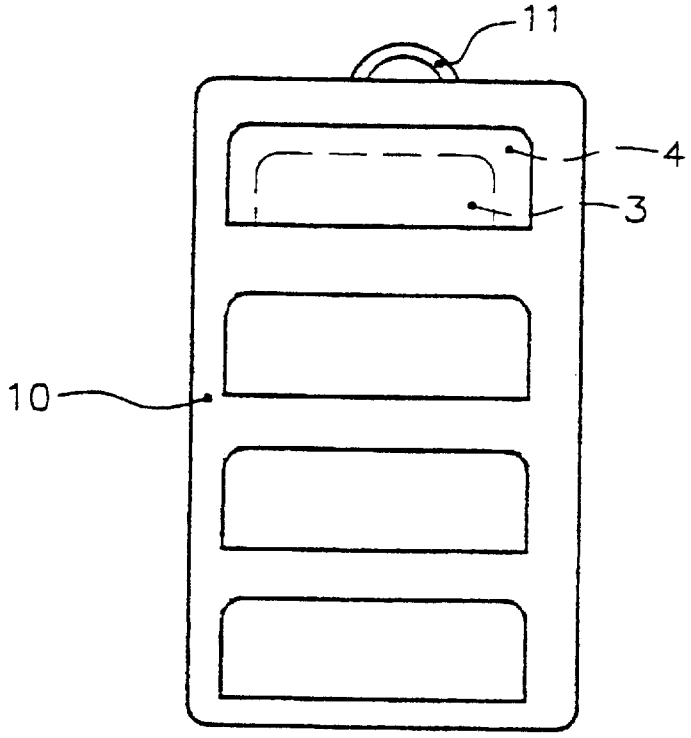
FIG. 5 is a variation of the holder of the invention is an elevational front view suited for being attached to a wall.

FIG. 5, the stamp holder comprises a plate 10 from which main and auxiliary wings, parallel and spaced apart, extend as in the previous example. An hanging member 11 extends form the upper side of plate 10, for example of semi-annular shape, for being engaged with a hook not shown fixed to a wall.

In this case the stamp holder car be hung to a vertical surface.

Figure 6:
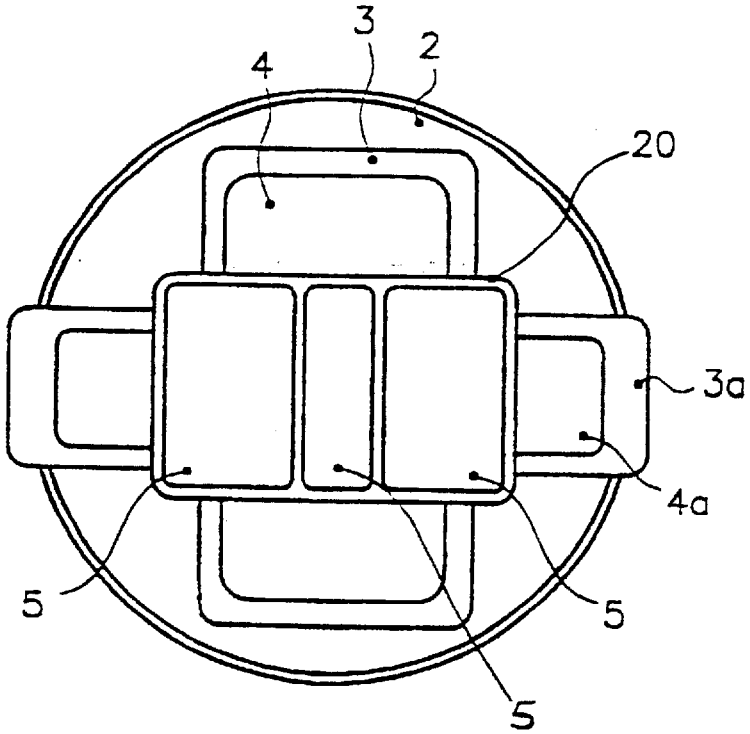
FIG. 6 is a plan view of a further variation of the holder of the invention.

In another variation of the present invention shown in FIG. 6, the stamp holder comprises an upright 20 of quadrilateral section, wherein wings 3 and 4 extend from all the four side faces thereof. In particular, shorter first and second wings 3*a* and 4*a* extend from the pair of opposed faces of smaller width.

Figure 2:
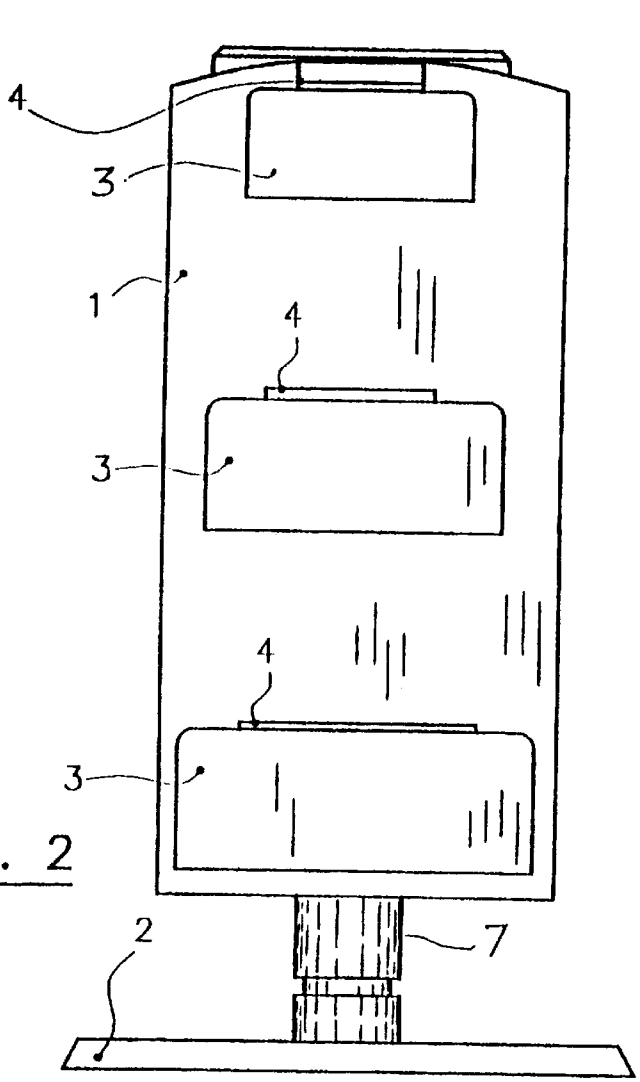
FIG. 2 is an elevational front view of the self-inking stamp holder in the direction of arrow F of FIG. 1.
Figure 1:
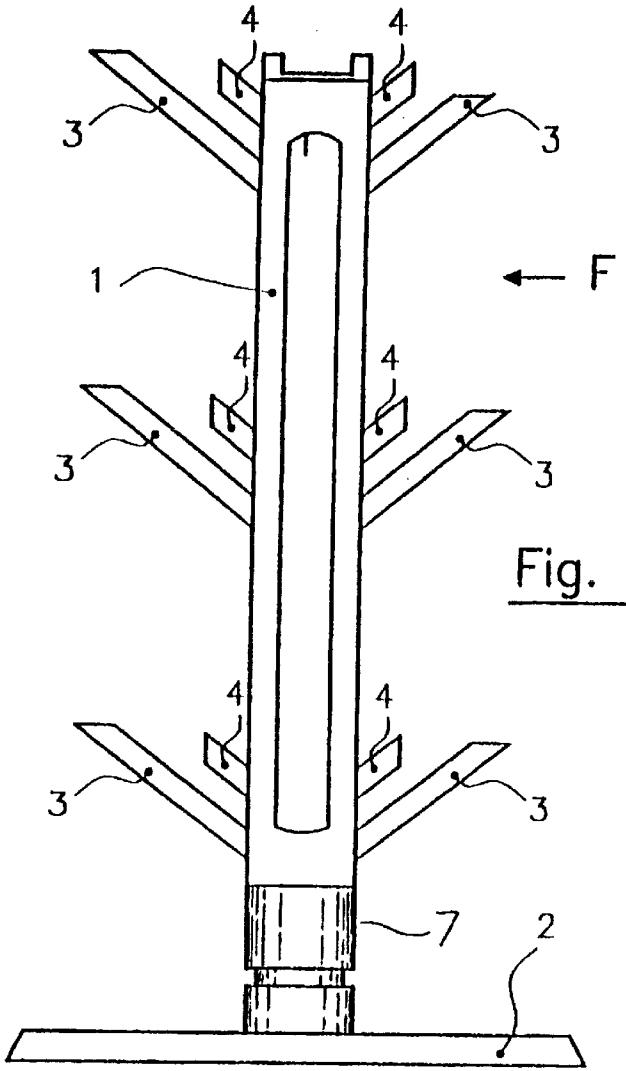
FIG. 1 is an elevational side view of the self-inking stamp holder according to the present invention.

Thanks to this configuration it is possible to use the stamp holder to hold stamps of different sizes. Clearly, first and second wings of different sizes can also be provided on the same face, as shown for example in the embodiment of FIGS. 1 and 2.

The stamp holder according to the invention can be made of metal or plastics according to design and production choices as obvious for a person skilled in the art.

Wings 3 and 4 can be parallel to each other, as provided for in the embodiments shown in the drawings, or even slightly diverging. This solution can be useful to allow for stamps of different manufacturers with different frame or case thickness to be engaged with wing 3.

Upright 1 can be made of only one member or be formed by modular members for example snap-fixed onto one another to increase the height and consequently the capacity of the stamp holder.

Figure 7:
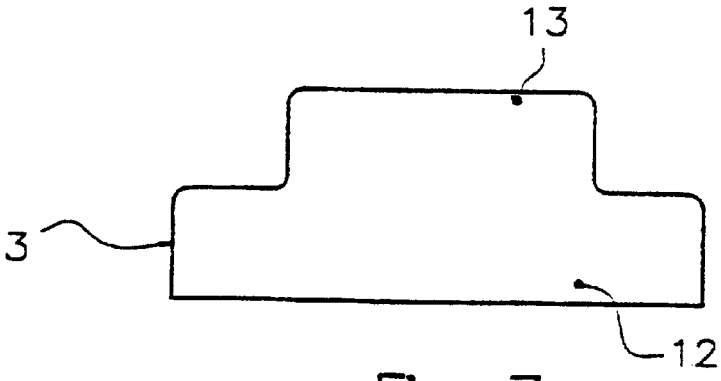
FIG. 7 is a front view of a differently shaped wing for the holder of the invention.

In order to allow stamps of different width to be held by the same wing, the wing can be shaped as shown in FIG. 7, i.e. formed by two parts 12 and 13 of different width.

Figure 8:
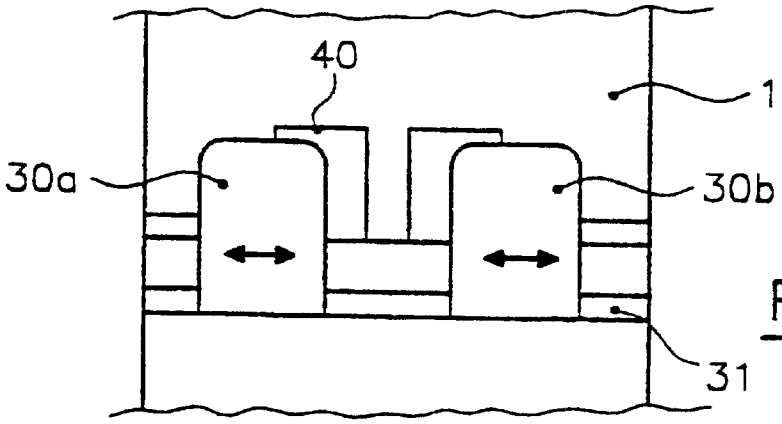
FIG. 8 is a front view of an adjustable width wing.
Figure 9:
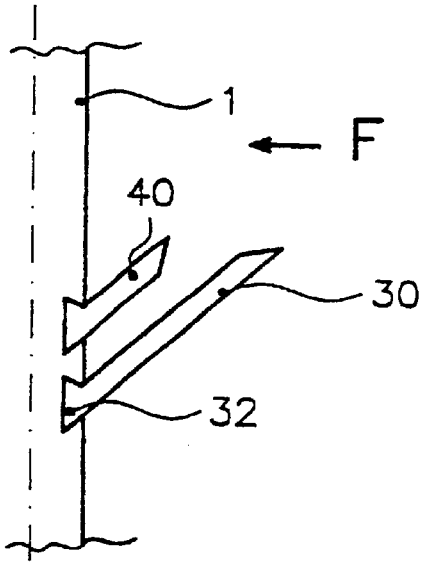
FIG. 9 is a partial side view of the holder equipped with the adjustable width wing of FIG. 8.

In another variation of the invention shown in FIGS. 8 and 9 the wings have a variable width according to the needs. To this end transverse grooves 31 shaped as a dovetail are formed on upright 1. Dovetail-shaped roots 32 of two wing members 30*a* and 30*b* engage in a slightly forced way within grooves 31, so that the wing members can be slid toward one another, or vice versa, to discrease or increase their supporting width. Obviously, any equivalent sliding connection means can be used as an alternative to achieve the same purpose.

In a further variation of the invention, wings 3 and 4 can be arranged at a distance such as to provide a housing for the stamp therebetween. In this case, the support for the stamp by means of the wing is not achieved by holding the frame or case to wing 3, but by housing the frame or case on wing 3. In this case connection side walls could be provided between wings 3 and 4 to close them laterally thus forming something similar to a drawer.

In order to increase the friction between wings 3 and 4 from one side and frame or case of the stamp from the other side and to further reduce the risk of accidental fall of the stamp from the holder, the wing surface can be at least partially coated with an high friction coefficient material.

Further variations and/or modifications can be brought to the self-inking stamp holder according to the present invention, without departing from the scope of the invention as set forth in the appended claims.

What is claimed is:

1. A holder for self-inking stamps, (said stamps comprising a box-like frame or case with openings on at least two opposite sides and a slider containing an overturnable stamping member and an inking pad, elastically sliding within said frame or case between said openings, characterized in that it comprises an upright (1) and a plurality of main wings (3) extending obliquely in a parallel relationship from at least one face thereof, each wing being capable of holding a stamp, retaining means (4) being associated to each of the main wings (3) for abutting on said frame or case, when held from a respective main wing, from the opposite side of said main wing, to firmly secure the stamp in position thereon.

2. The holder according to claim 1, further comprising a base (2) pivotally connected to said upright for supporting said upright (1) on a flat surface.

3. The holder according to claim 1, wherein said upright further comprises hook means for hanging said upright to a wall.

4. The holder according to one of the previous claims, wherein said plurality of main wings (3) extends from at least two opposite faces of said upright.

5. The holder according to claim 1, wherein said retaining means associated to each of said main wings (3) comprise an auxiliary wing (4) extending from said upright immediately above said main wing.

6. The holder according to claim 5, wherein said auxiliary wing (4) is parallel to the respective main wing (3).

7. The holder according to claim 5, wherein said auxiliary wing (4) is diverging with respect to said main wing (3).

8. The holder according to claim 1, wherein said main wing (3) is fit for engaging with one of said opening of said box or case of the stamp, which thus hangs therefrom, said auxiliary wing (4) abutting on the outer side of said frame or case to balance the weight of the stamp.

9. The holder according claim 1, wherein the distance between each main wing and the respective retaining means is larger than the thickness of a stamp which can be placed therebetween.

10. The holder according to claim 1, wherein from said upright there extend main wings of different width to hold stamps of correspondingly different sizes.

11. The holder according to claim 1, wherein said main wings and said auxiliary wings are movably connected to said upright.

12. The holder according to claim 11, wherein said main wings are formed by at least to wing members (30*a*, 30*b*) slidable on said upright.

13. The holder according to claim 11 or 12, wherein on said upright there are formed parallel, dovetail-shaped grooves within which slidably engage correspondingly shaped roots of said main and auxiliary wings.

14. The holder according to claim 1, wherein said main wings and said auxiliary wings are at least partially coated with an high friction coefficient material.

15. The holder according to claim 1, wherein said wings are formed in two parts of different width to engage stamps of correspondingly different width.

* * * * *